US010441102B1

(12) United States Patent
Bunting

(10) Patent No.: US 10,441,102 B1
(45) Date of Patent: Oct. 15, 2019

(54) BEVERAGE CONTAINER HOLDER WITH COVER FOR MOUTH OF BEVERAGE CONTAINER

(71) Applicant: Thomas Leland Bunting, Hockley, TX (US)

(72) Inventor: Thomas Leland Bunting, Hockley, TX (US)

( * ) Notice: Subject to any disclaimer, the term of this patent is extended or adjusted under 35 U.S.C. 154(b) by 174 days.

(21) Appl. No.: 15/590,801

(22) Filed: May 9, 2017

Related U.S. Application Data

(60) Provisional application No. 62/333,390, filed on May 9, 2016.

(51) Int. Cl.
*B65D 81/38* (2006.01)
*A47G 23/02* (2006.01)

(52) U.S. Cl.
CPC ..... *A47G 23/0233* (2013.01); *B65D 81/3876* (2013.01); *A47G 2023/0291* (2013.01)

(58) Field of Classification Search
CPC ..... B65D 81/3876; A47G 23/0233; A47G 2023/0291
USPC ..... 220/740, 737, 739
See application file for complete search history.

(56) References Cited

U.S. PATENT DOCUMENTS

| | | | | |
|---|---|---|---|---|
| 9,526,364 | B1 * | 12/2016 | Lovison | A47G 23/0216 |
| 2006/0231562 | A1 * | 10/2006 | Carroll | B65D 81/3879 220/737 |
| 2008/0128421 | A1 * | 6/2008 | Ulbrand | B65D 51/24 220/375 |
| 2013/0026163 | A1 * | 1/2013 | Hawkins | B65D 25/34 220/4.01 |

* cited by examiner

*Primary Examiner* — Stephen J Castellano
(74) *Attorney, Agent, or Firm* — Karen B. Tripp

(57) ABSTRACT

A portable, personal sized, beverage container holder or kouzie with cover to prevent entry of insects and spiders into open beverage container. The cover also prevents spillage of beverage from the container. The holder includes a sleeve to receive the container and a cover to fit over the mouth of the container. The cover is removable and detachable but allows drinking from the container without removal of the cover or the container from the holder.

10 Claims, 18 Drawing Sheets

BEVERAGE CONTAINER HOLDER WITH COVER FOR MOUTH OF BEVERAGE CONTAINER

RELATED APPLICATION

The present invention claims priority from U.S. Provisional Patent Application Ser. No. 62/333,390, filed May 9, 2016.

FIELD OF THE INVENTION

The present invention relates to the field of personal-sized holders for beverage containers, and more particularly to Koozie®-type container holder.

BACKGROUND OF THE INVENTION

The can was invented in 1795 by Nicolas Appert to preserve food for the French army and navy during the rule of Napoleon Bonaparte. Since then, the can has played a persistent and important role in modern life. An estimated 130 billion cans are used by Americans each year. Many of these cans are used as individual beverage containers, especially as vessels for beer and soft drinks, which, as well as bottles, enable persons to enjoy a beverage while traveling, attending or participating in a sporting event, or while simply on the run.

To enhance the experience of consumers of various canned beverages, the can holder was invented. The can holder is typically a sleeve made of a soft material or fabric such as for example leather, neoprene, EVA, polyester, vinyl, or foam, but hard plastic and metal holders, are also known and popular. Usually, the can holder provides or is intended to provide thermal insulation to the can, or bottle, so that the radiant heat from the sun, ambient heat around the can, and the heat from a user's hand will not quickly warm the beverage, particularly on hot days. The can holder also provides a comfortable way for the user to hold a canned beverage, and a canvas for the user to display personal information such as a sport team loyalty.

Insulated can holders typically fit tightly about the can and extend at least half way up the can, allowing room for opening and drinking from the can, as shown, for example in U.S. Pat. No. 4,293,015 (McGough), and as is known with the popular Rambler Colster® by YETI Coolers. Insulated holders have been adapted similarly to individual sized bottles for the same purposes as such holders are used for cans. The insulated holders for bottles also similarly typically fit tightly about the bottle and extend at least half way up the bottle, allowing room for opening and drinking from the bottle. These insulated sleeves used to keep a canned or bottled drink cold are now commonly called "Koozies."

Many canned and bottled beverages are consumed outdoors, and it is known that various insects and spiders may crawl or fly into open beverage containers, especially when they are left unattended, even for a short time. The design of known personal sized, portable, cans and bottles do not prevent such entry and neither do Koozie®-type container holders. "Koozie" is a registered trademark of Norwood Promotional Products, Inc. of Indianapolis, Ind. Anyone who has been surprised to find such a bug inside their drink upon returning to it after a short time away fully appreciates the need for protecting the opening of the can or beverage. However, personal sized, portable cans do not typically have closeable openings, and neither do known Koozie®-type container holders. Beverage cans today have "stay-tabs" which, while non-removing, once pulled for opening the can, do not close back. Some bottles have caps that are usually tossed after opening, and some bottles reusable tops which can be used to reseal or close the bottle, however, but such tops are typically removable and are often lost or purposefully thrown away.

There is a need for securing the mouth of an open, personal sized, beverage can or bottle to prevent or at least discourage entry of insects and spiders when the can or bottle is left open and unattended outdoors.

SUMMARY OF THE INVENTION

According to one aspect of the present invention, there is provided a portable, personal sized beverage container holder or Koozie®-type container holder with a cover. The cover fits over the mouth of the beverage container.

BRIEF DESCRIPTION OF THE DRAWINGS

The present invention will be better understood by referring to the following detailed description of preferred embodiments and the drawings referenced therein, in which.

DETAILED DESCRIPTION OF THE INVENTION

Figure 2:
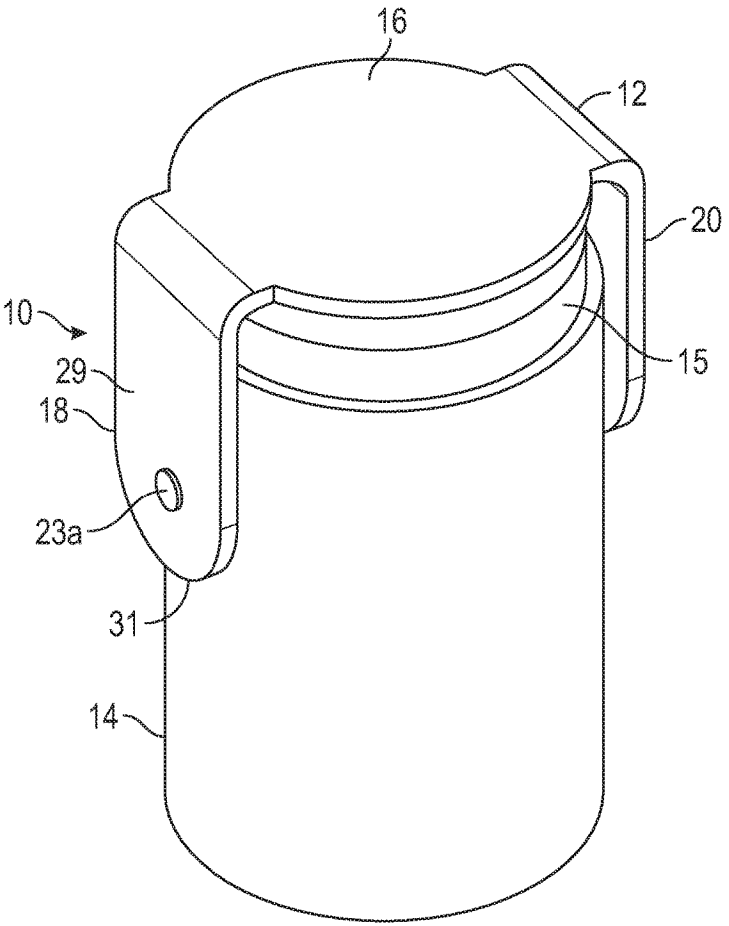
FIG. 2 is a right side perspective view of the container holder of FIG. 1.

The present invention provides a device for holding beverages contained in cans or bottles, and particularly for protecting the beverages from insects and spiders when left unattended outdoors, and even for protecting against or alleviating spillage indoors.

Referring now to the drawings, it should be understood that the scale of the drawings and parts thereof may or may not be rigorously to scale, but provided in the manner presented for illustrative purposes.

Figure 7:
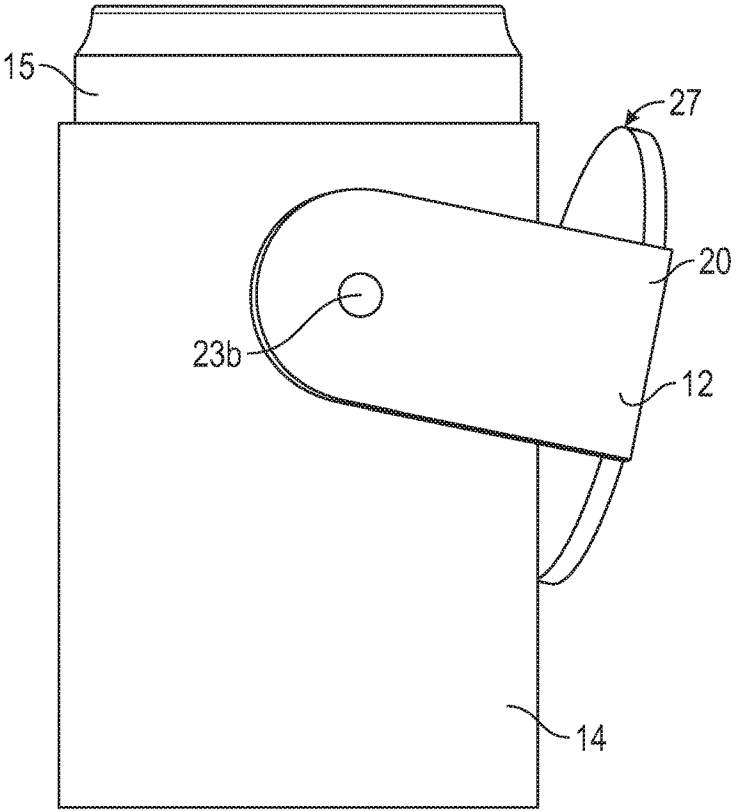
FIG. 7 is a front view of the container holder of FIGS. 1 and 3.
Figure 10:
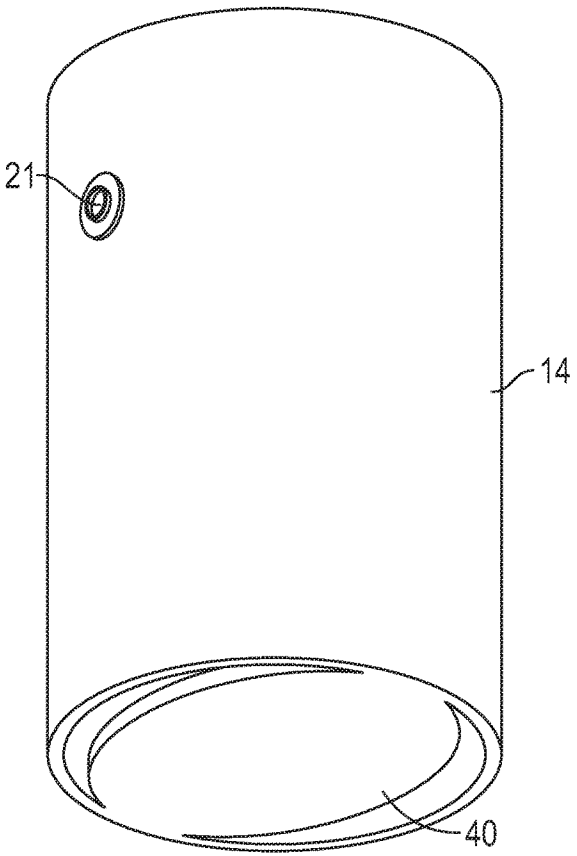
FIG. 10 is a right bottom perspective view of the container holder of FIG. 1.
Figure 9:
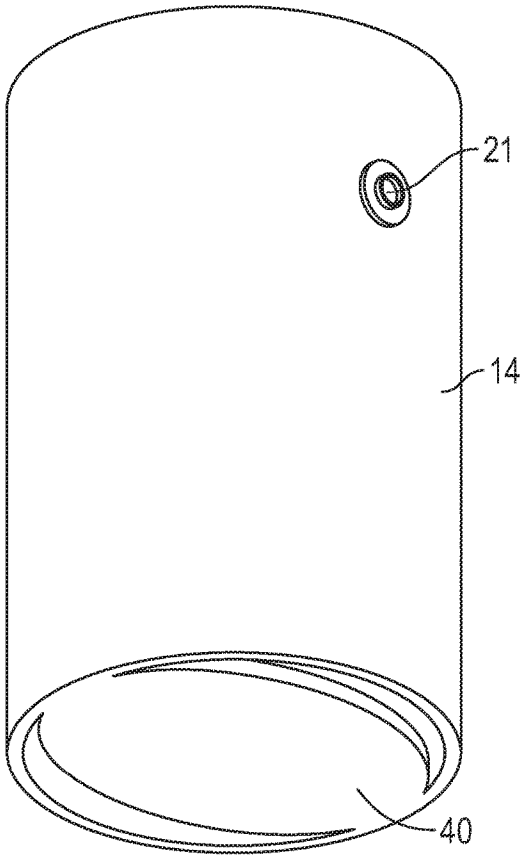
FIG. 9 is a left bottom perspective view of the container holder of FIG. 1.

One embodiment of a beverage container holder 10 of the present invention is shown in FIGS. 1 through 17. In this embodiment, holder 10 comprises a rotatable, detachable cover 12 and a sleeve 14. This embodiment shows holder 10 particularly suited or sized for holding a can 15. Cover 12 generally covers the top of can 15 when can 15 is positioned in sleeve 14. Cover 12 may be rotated to the side, or down, depending on one's perspective, as shown in FIG. 7 to allow entry of the can 15 into the sleeve 14. Can 15 is a typical individual or personal sized beverage can which holds 12 U.S. fl oz or 355 ml. The U.S. standard can is said to be 4.83 inches high, 2.13 inches in diameter at the lid, and 2.60 inches in diameter at the widest point of the body (https://en.wikipedia.org/wiki/Beverage_can). Can 15 is not itself part of the present invention but is included in the drawings and this specification as it is one type of can for which the present invention is useful. The holder 10 of the invention can be sized for smaller or larger cans than this standard.

Figure 11:
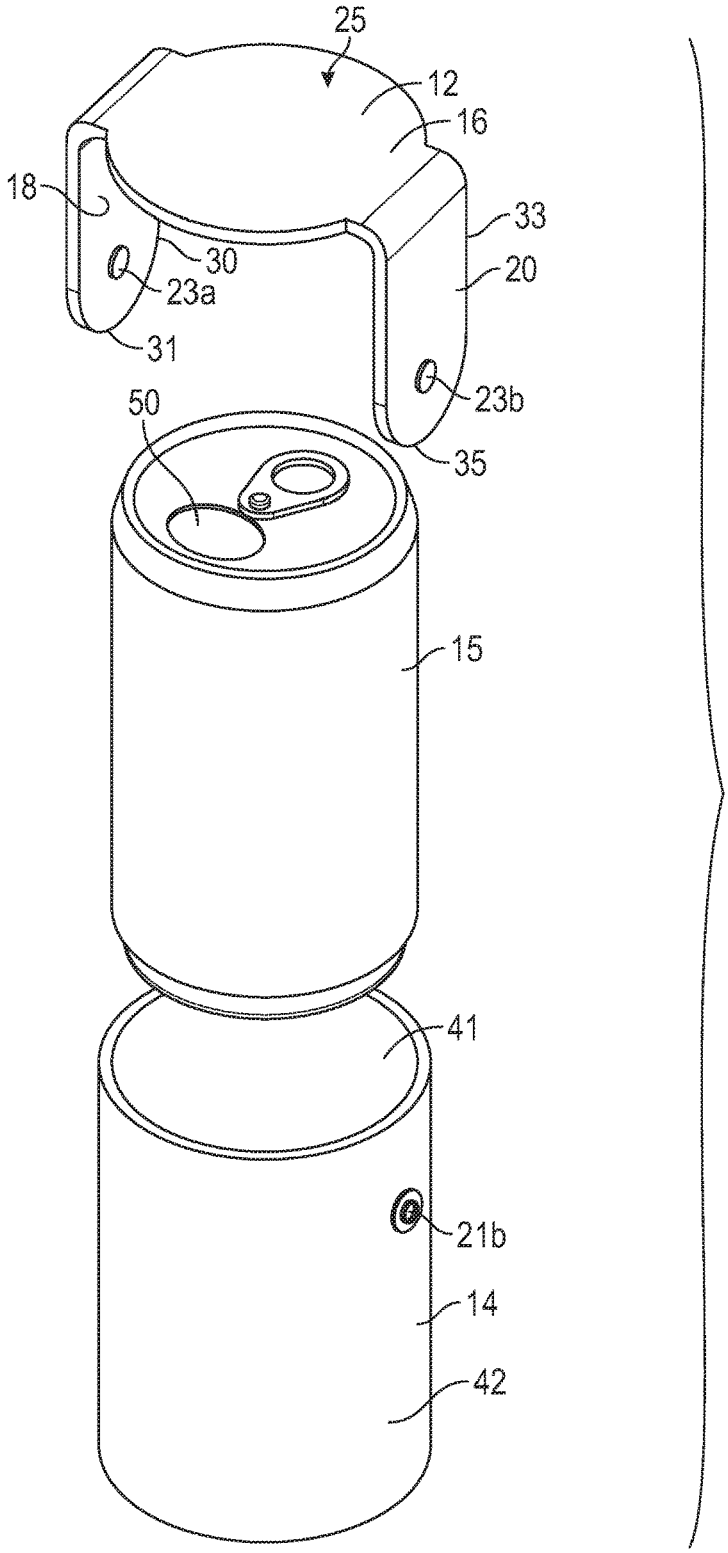
FIG. 11 is an exploded view of the container holder of FIG. 1.
Figure 12:
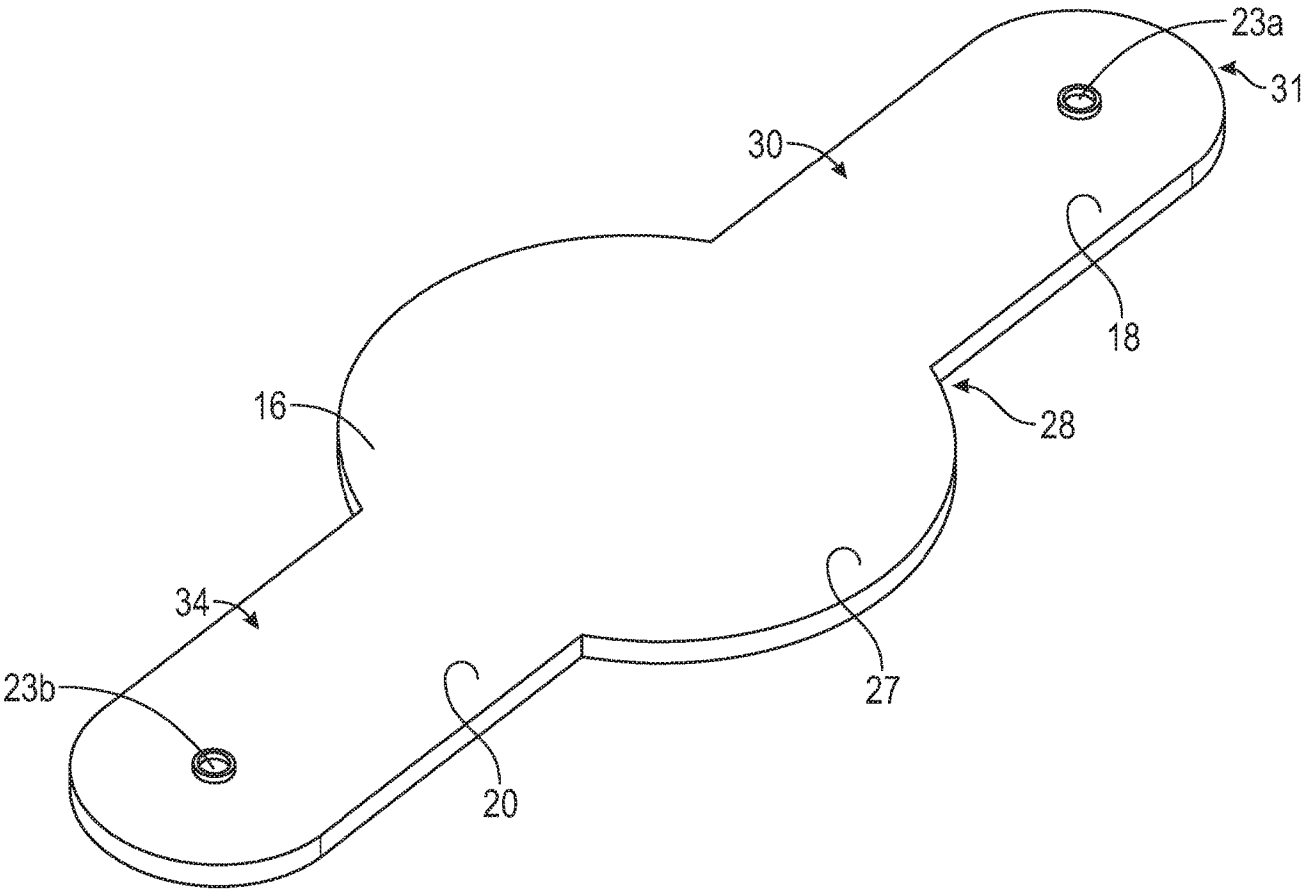
FIG. 12 is a bottom perspective view of the cover of the container holder of FIG. 1.
Figure 14:
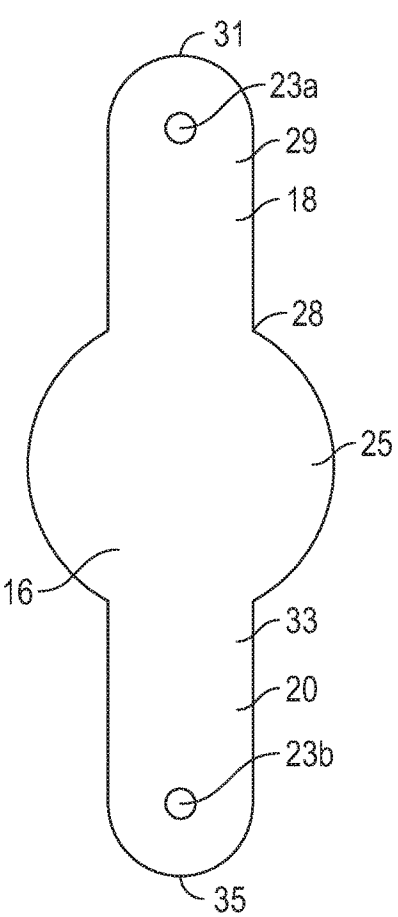
FIG. 14 is a top view of the cover of the container holder of FIGS. 1, 12, and 13.
Figure 13:
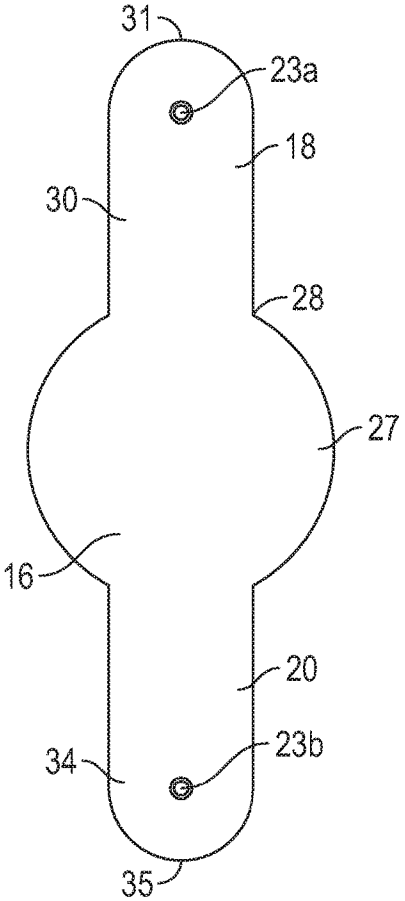
FIG. 13 is a bottom view of the cover of the container holder of FIGS. 1 and 12.
Figure 16:
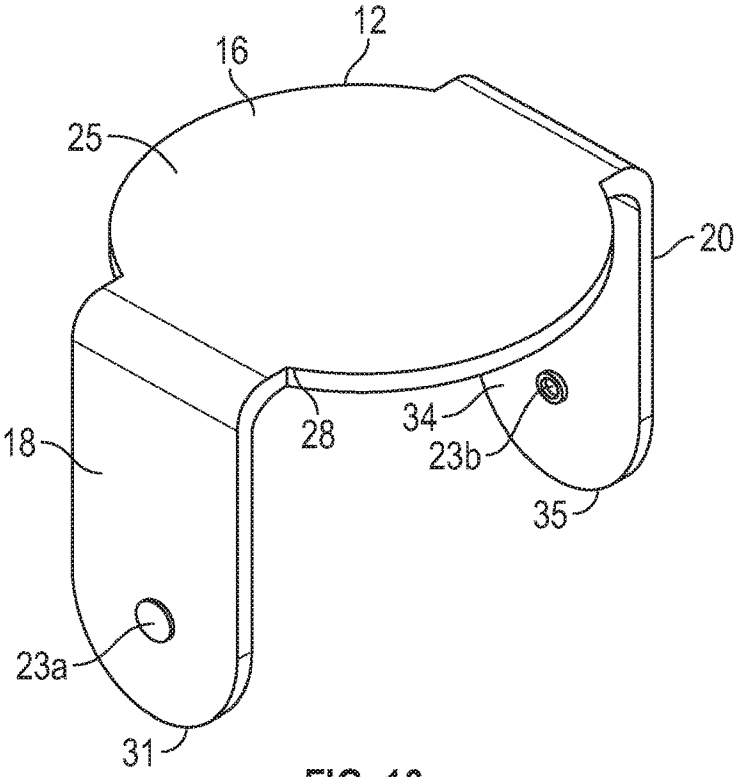
FIG. 16 is a right perspective view of the cover of the container holder of FIG. 1.
Figure 15:
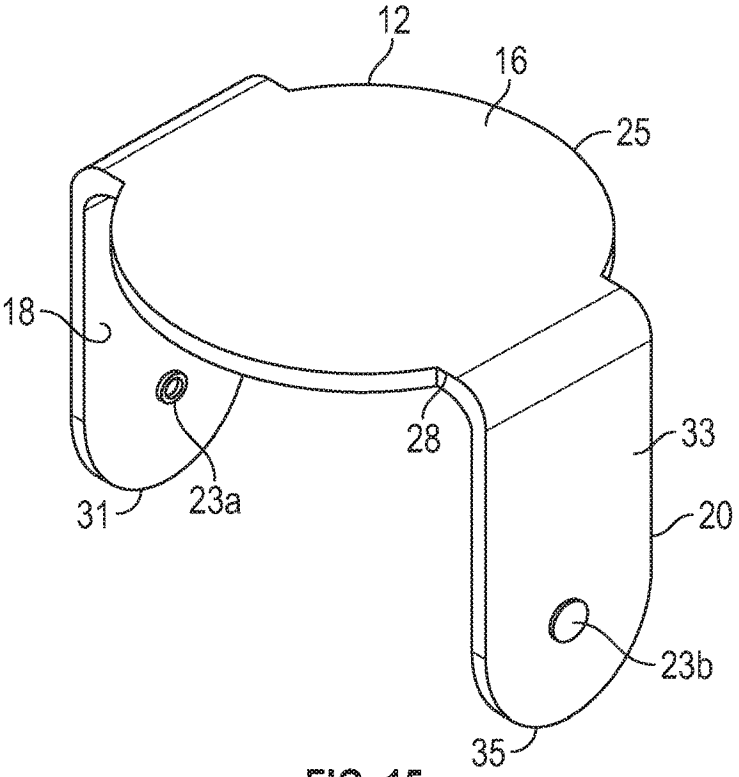
FIG. 15 is a left perspective view of the cover of the container holder of FIG. 1.

Cover 12 of holder 10 of the invention comprises a disk 16, a first flap 18, and a second flap 20. Cover 12 also comprises an attacher or fastener for attaching or fastening cover 12 to sleeve 14. Such fasteners can be snaps 22, as shown in FIG. 11 with the male snap piece 21 on the sleeve 14 and the female snap piece 23 on the cover 12, or vice versa albeit not shown with the female snap piece on the sleeve 14 and the male snap piece on the cover 12. In an alternative embodiment not shown, cover 12 and sleeve 14 are one piece. However, in the embodiments shown in the Figures, cover 12 is a separate piece attached to sleeve 14. Further, in the embodiments shown in the Figures, cover 12 is removable from sleeve 14. However, in a still further alternative embodiment not shown, cover 12 is attached to sleeve 14 by an attacher or fastener that affords some movement of cover 12 as will be discussed further below and as is shown in the FIGS. 3, 4, 21, 27, and 33, but is not removable or disconnectable from sleeve 14 as shown in the Figures herein. Snaps 22 comprised of plastic are generally preferred over snaps comprised of metal for lightness in weight and resistance to rust. Non-limiting examples of alternative fasteners or attachers that can be used to attach cover 12 to sleeve 14 include brads and buttons. In one alternative embodiment not shown employing such alternative fasteners or attachers to snaps, a hole is used in the cover 12 in lieu of a female snap piece, and the brad or button is on the sleeve 14 for receiving the hole in the cover 12, in lieu of a male snap piece.

Figure 8:
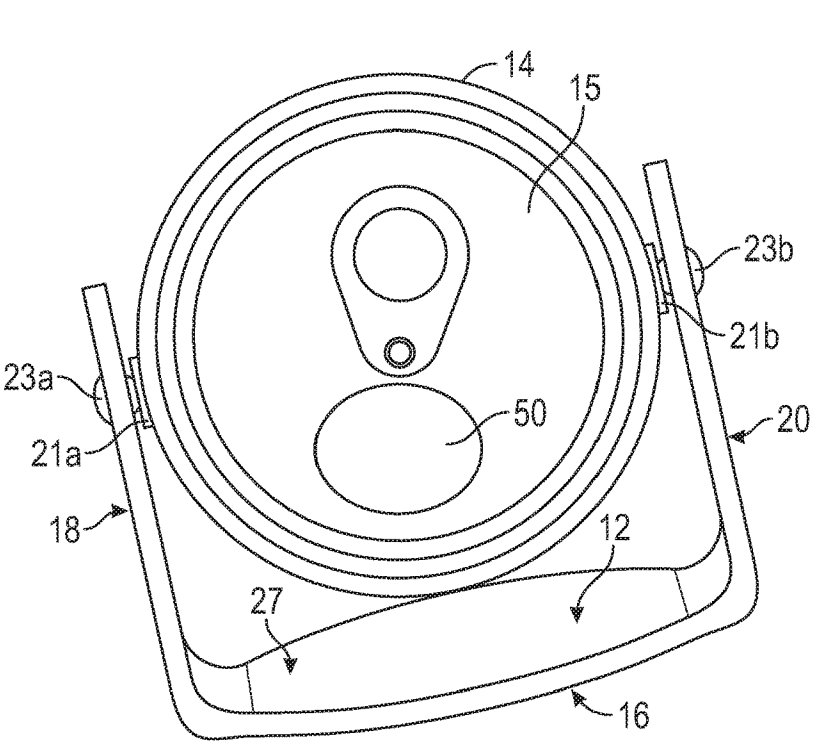
FIG. 8 is a top view of the container holder of FIG. 1 with the cover slipped off the mouth of the can.

Disk 16 is generally circular, and at least in one embodiment is flat, and is approximately the same size as the top of can 15. Disk 16 comprises an upper disk surface 25 and a lower disk surface 27. In use according to the invention, the upper disk surface 25 does not come into contact with can 15, as shown in FIGS. 1 through 6. The lower disk surface 27 comes into contact with the top or a portion of the top of can 15. The lower disk surface 27 alternatively comes into contact with the sleeve 14 when the cover 12 is rotated as shown in FIGS. 7 and 8.

The first flap 18 of the cover 12 extends radially in a first direction from the edge 28 of disk 16. The first flap 18 comprises a first upper flap surface 29, a first lower flap surface 30, a first rounded edge 31, and a first female snap 23*a*. In use according to the invention, the first upper flap surface 29 does not come into contact with the sleeve 14. The first lower flap surface 30 does come into contact with the sleeve 14. The first rounded edge 31 is at the end of the first flap 18 and distal to disk 16. First female snap 23*a* is the female side of a snap fastener 22, and mates with the first male snap 21*a* on sleeve 14 as shown in FIG. 8.

The second flap 20 of the cover 12 extends radially in a second direction from the edge 28 of the disk and approximately 180 degrees from the first flap 18. The second flap 20 further comprises a second upper flap surface 33, a second lower flap surface 34, a second rounded edge 35, and a second female snap 23*b*. The second rounded edge 35 is at the end of the second flap 20 and distal to disk 16. Second female snap 23*b* is the female side of a snap fastener 22, and mates with the second male snap 21*b* on sleeve 14 as shown in FIG. 8.

The sleeve 14 surrounds the sides of can 15, which is held by holder 10 of the present invention. In addition to the material surrounding the sides and bottom of can 15, sleeve 14 comprises a first male snap 21*b* and a second male snap 21*b* as stated above. In one embodiment, sleeve 14 also comprises a bottom or bottom surface 40 as shown in FIGS. 9 and 10 and 17 and 18 to further hold can 15.

Sleeve 14 typically covers at least the lower portion of the sides of can 15 and more typically covers all or most all of the sides of can 15 to the top of can 15 as shown in the Figures. Sleeve 14 is generally a cylindrical tube, comprising an inner surface 41 and an outer surface 42. The sleeve inner surface 41 makes contact with the sides of can 15. The sleeve outer surface 42 makes contact with a user's and when that user is holding the holder 10 of the present invention. In one embodiment, the sleeve outer surface 42 has added thereto or otherwise includes or comprises frictional or padded material (not shown) for additional user comfort and grip. The sleeve outer surface 42 may also include an insignia or design that will enable a user to express himself or herself, or differentiate his or her beverage from other beverages inside similar holders. Such insignia or design might be provided by the user or by an advertiser supplying the holder to the user and will typically be imprinted on the sleeve outer surface 42. In one embodiment, such insignia or design may be imprinted on cover 12.

The first male snap 21*b*, located on sleeve 14, is positioned about one-quarter to one third of the way down from the upper edge of the sleeve 14. The first male snap 21*b* is the male side of a snap fastener 22 and mates with the first female snap 23*b* on flap 20, as shown in FIG. 8.

Figure 18:
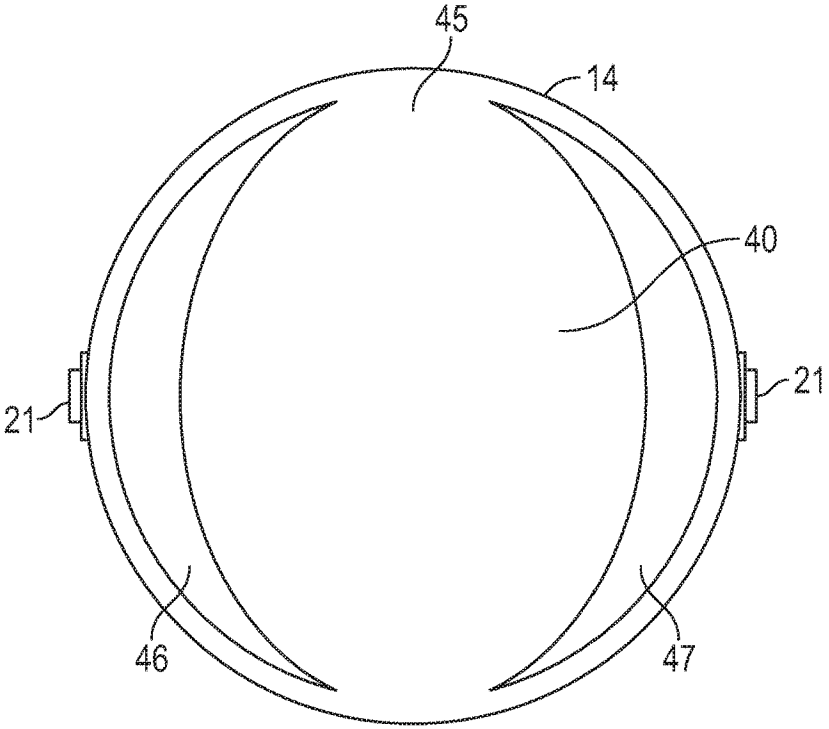
FIG. 18 is a bottom view of the container holder of FIG. 1 without the cover.
Figure 17:
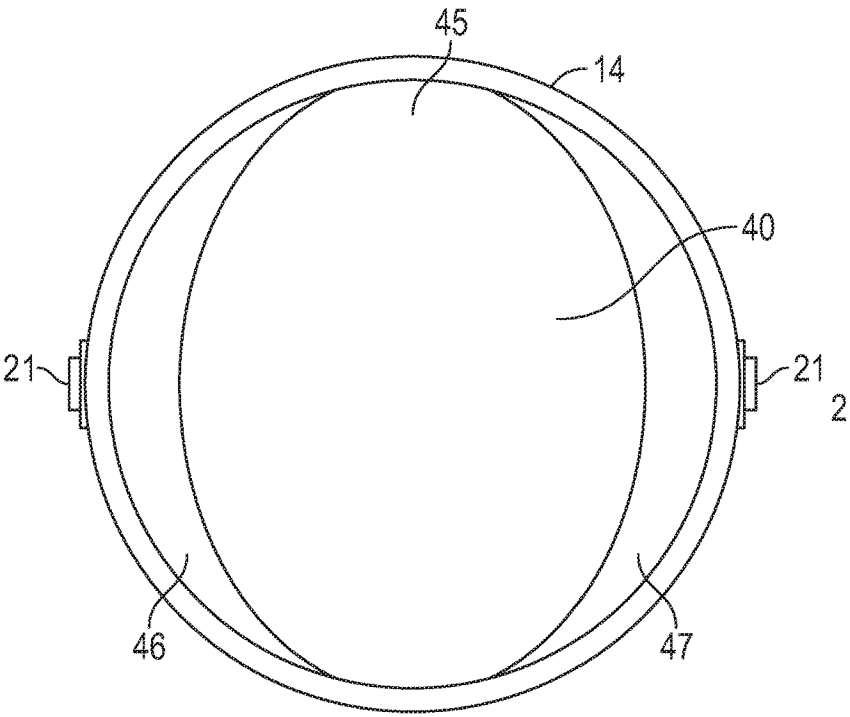
FIG. 17 is a top view of the container holder of FIG. 1 without the cover.

The bottom surface 40 at least partially covers the bottom of can 15 and makes contact with the bottom of can 15. The bottom surface 40 in one embodiment comprises a central strip 45, a first peripheral gap 46, and a second peripheral gap 47 as shown in FIGS. 17 and 18. The central strip 45 extends transversely across the bottom surface 40, to help prevent the can 15 from falling through the sleeve 14. In one embodiment, the central strip 45 has an elliptical or oval shape. The first peripheral gap 46 is a hole between the central strip 45 and the lowermost inner edge of the sleeve 14 on a first side of he central strip 45, and the second peripheral gap 47 is a hole between the central strip 45 and the lowermost inner edge of the sleeve 14 on a second side of the central strip 45, opposite the first peripheral gap 46. In one embodiment, the first and second peripheral strips 46 and 47 respectively have a crescent shape as shown in FIG. 18.

Figure 4:
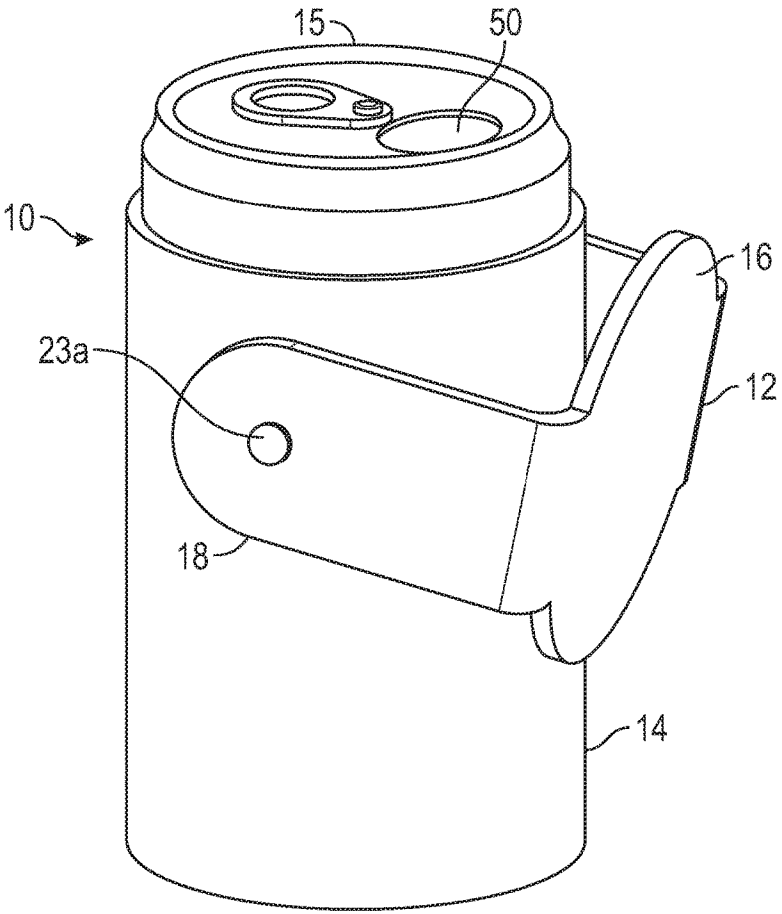
FIG. 4 is a left side perspective view of the container holder of FIG. 1 with the cover slipped off the cover of the mouth of the can inside the container holder, showing the can opening.
Figure 3:
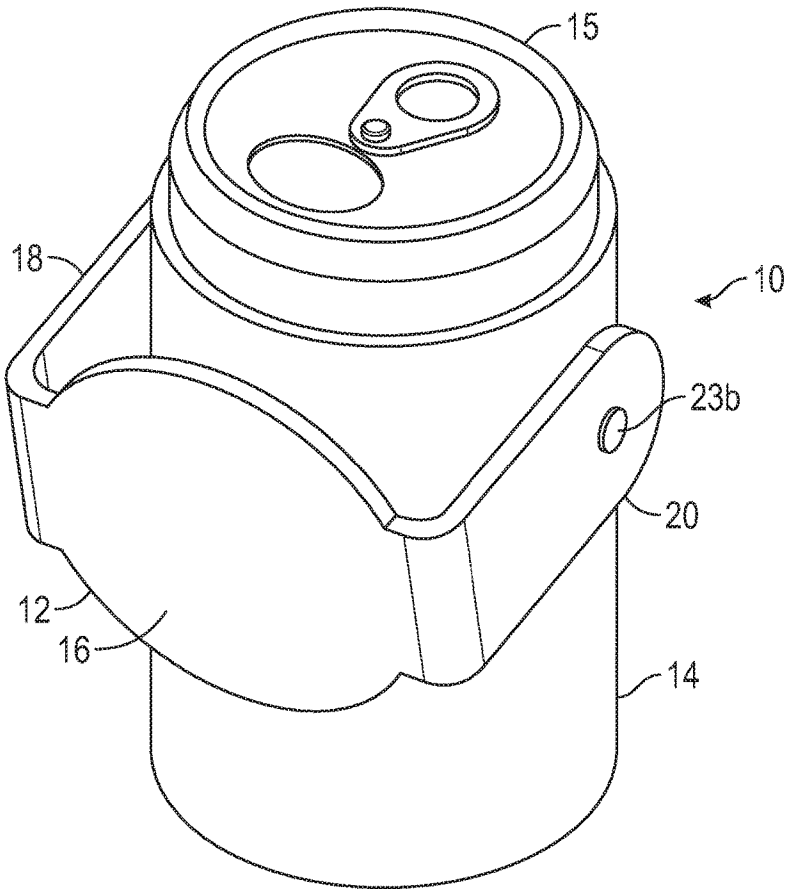
FIG. 3 is right side perspective view of the container holder of FIG. 1 with the cover slipped off the mouth of the can inside the container holder, showing the can opening.
Figure 6:
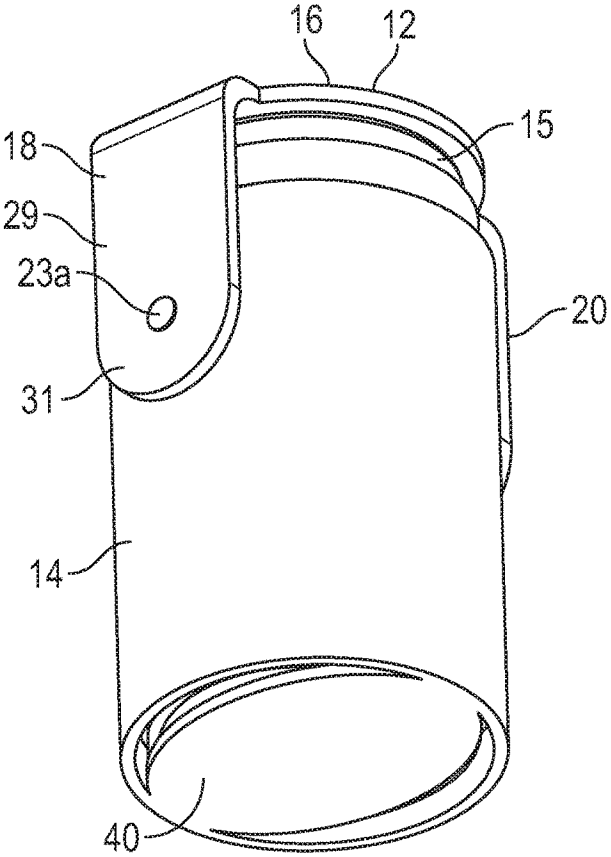
FIG. 6 is a bottom right side perspective view of the container holder of FIG. 1.
Figure 5:
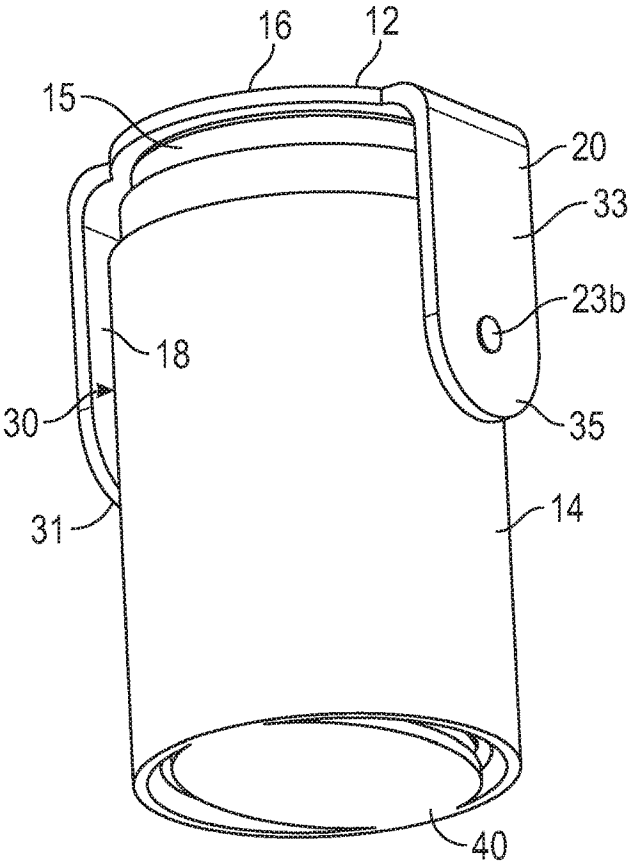
FIG. 5 is a bottom left side perspective view of the container holder of FIG. 1.
Figure 19:
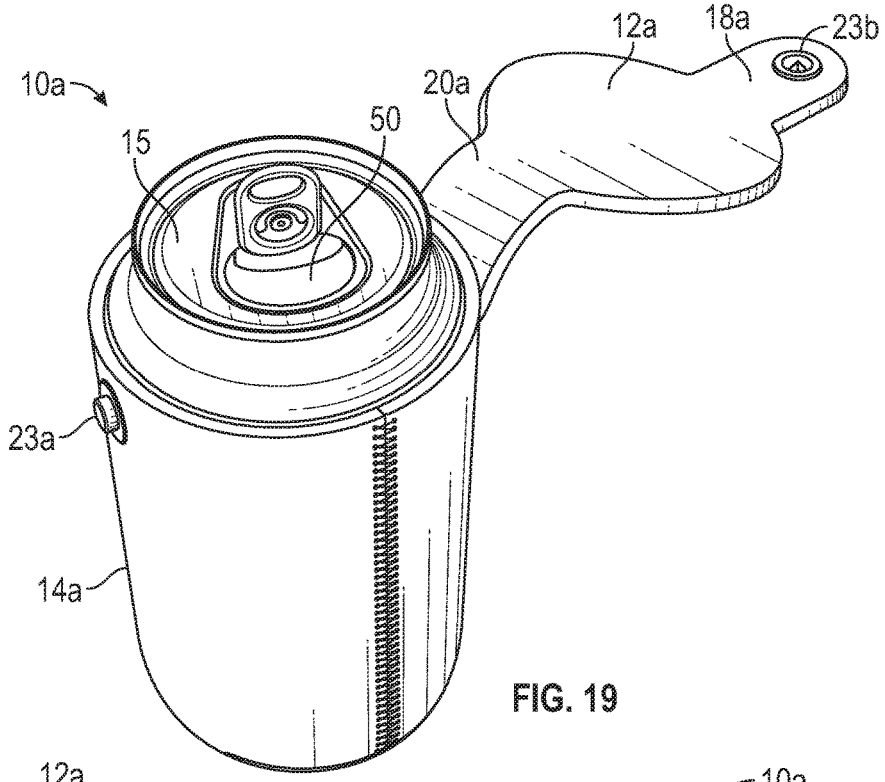
FIG. 19 is a perspective view of a further embodiment of a beverage container holder or Koozie®-type container holder with cover of the present invention, particularly suited for a can, showing the cover flipped open away from the mouth of the can inside the container holder.

When the present invention is used, the user inserts can 15 into sleeve 14. If cover 12 is not already attached to sleeve 14 and moved aside by the user as discussed above to allow such insertion, as shown in FIGS. 3 and 4, then the user may attach cover 12 after inserting can 15 into sleeve 14. For attaching cover 12 to sleeve 14, the user attaches the first female snap 23*a* of the first flap 18 to the first male snap 21*a* of sleeve 14, and the second female snap 23*b* of the second flap 20 to the second male snap 21*b* of sleeve 14. When the user wishes to take a drink from the can within the holder 10, the user rotates the cover 12 in a first direction with respect to the sleeve 14 as shown in FIGS. 3, 4, and 7, revealing the top of can 15 and particularly the mouth 50 of can 15. Alternatively, as will be discussed below in an alternative embodiment, the user may detach one flap and swing or push it back, revealing the top of can 15, and particularly the mouth 50 of can 15, as shown in FIG. 19. If desired, the user may thread one of the flaps, flap 18 or flap 20, through a belt loop before securing both snaps 22, thereby turning the holder 10 into a hands-free beverage carrying device.

Figure 1:
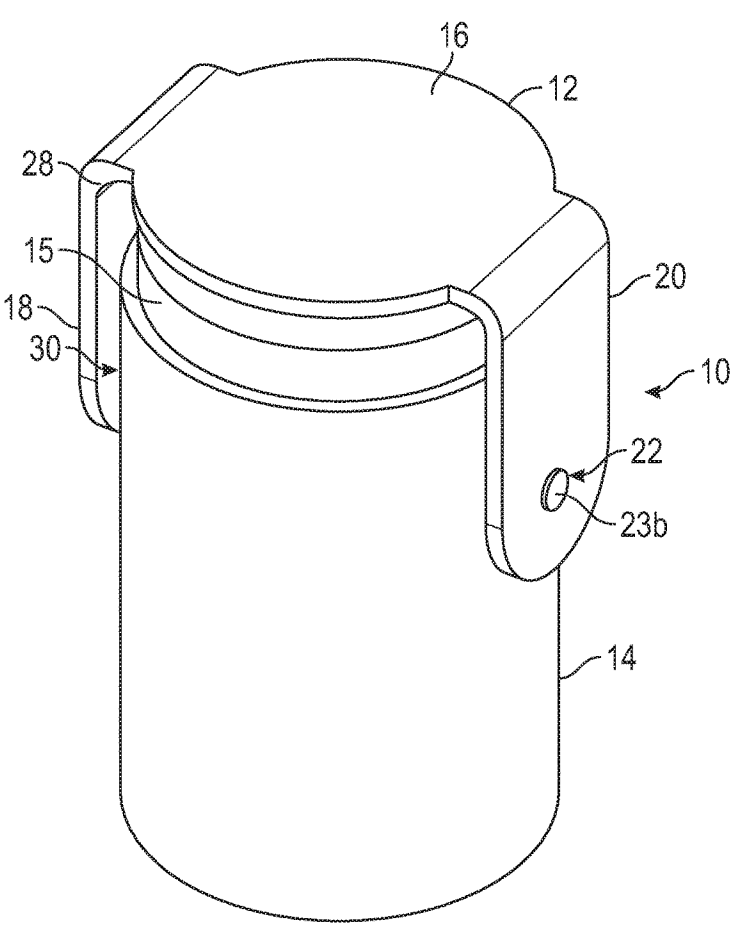
FIG. 1 is a left side perspective view of one embodiment of a beverage container holder or Koozie®-type container holder with cover of the present invention, particularly suited for a can, showing the cover over the mouth of a can inside the container holder.

When the user wishes to leave the beverage after a sip and return later, the user may return the cover to its initial closed position, as shown in FIGS. 1 and 2, rotating the cover in a second direction opposite to the first direction, or in the case of the alternative embodiment shown in FIG. 19, reattaching the flap of the cover to the sleeve. When the user has finished the beverage, and wishes to remove the can from the holder 10, the user may detach one or both of the female snaps 23 on the cover 12 from the male snaps 21 on the sleeve 14, and then push. the can 15 out of the sleeve 14 by pushing on the bottom of the can 15 with his or her fingers through the peripheral strips 46 and 47 or pulling the top of can 15. Once the can 15 has been removed from the holder 10, the holder 10 may be stored. In one embodiment, the holder 10 may be collapsed for storage. When the holder is collapsed for storage, the sides of the inner sleeve surface 14 are brought into contact with each other and the central strip 45 folds in half. In one embodiment, the holder 10 is disposable. In one embodiment, cover 12 may be replaced with a like cover 12, as may be desired for example to change colors or decorations on the cover.

Holder 10, and particularly cover 12 and sleeve 14, may be comprised of a variety of materials. One of skill in the art will appreciate that sleeve 14 may be a Koozie®-type container holder, and in one embodiment, sleeve 14 is comprised of one or more materials of which Koozie®-type container holders are commonly comprised, such as soft, flexible materials such as neoprene, polyester, vinyl, foam, leather, EVA, and flexible forms of plastic and flexible forms of rubber and synthetic rubber for non-limiting example. The sleeve may include or comprise insulating materials or itself be an insulator. In one embodiment, sleeve 14 is comprised of a waterproof or water resistant material. In one embodiment, sleeve 14 is comprised of an insulating material or an otherwise protective or easy-to-grip material that is not soft or flexible. For example, in one embodiment, sleeve 14 is comprised of one or more hard materials such as stainless steel, aluminum, copper, nickel, zinc, brass, other metals, and harder forms of plastic, rubber, and synthetic rubber for non-limiting example. In one embodiment, sleeve 14 is comprised of an insulating material encased in a hard or inflexible material.

Cover 12 may be comprised of the same material as sleeve 14 or of a different material. In one embodiment, cover 12 is comprised of one or more soft, flexible materials such as neoprene, polyester, vinyl, foam, leather, synthetic leather, EVA, flexible forms of plastic, and flexible forms of rubber and synthetic rubber for non-limiting example. In one embodiment, cover 12 is comprised of one or more hard materials such as stainless steel, aluminum, copper, nickel, zinc, brass, other metals, and harder forms of plastic, rubber, and synthetic rubber for non-limiting example. In one embodiment, cover 12 is comprised of an insulating material encased in a hard or inflexible material.

Figure 20:
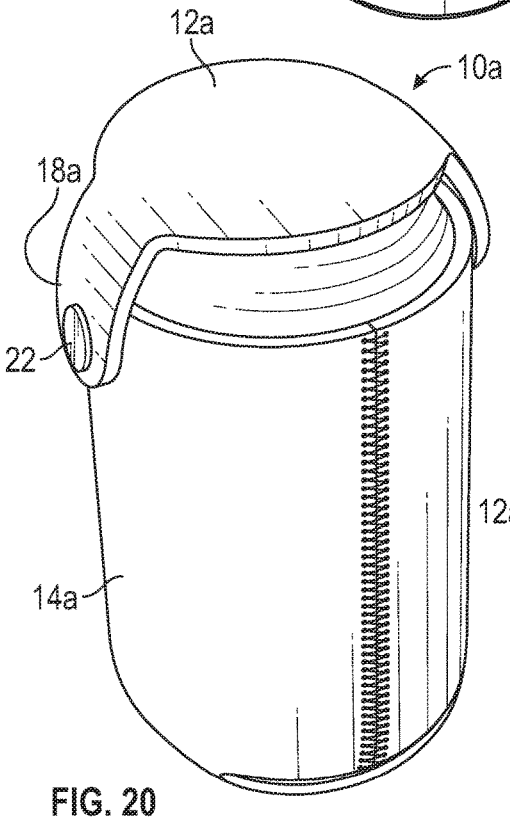
FIG. 20 is a perspective view of the container holder of FIG. 19 with the cover closed across the top of the can.
Figure 21:
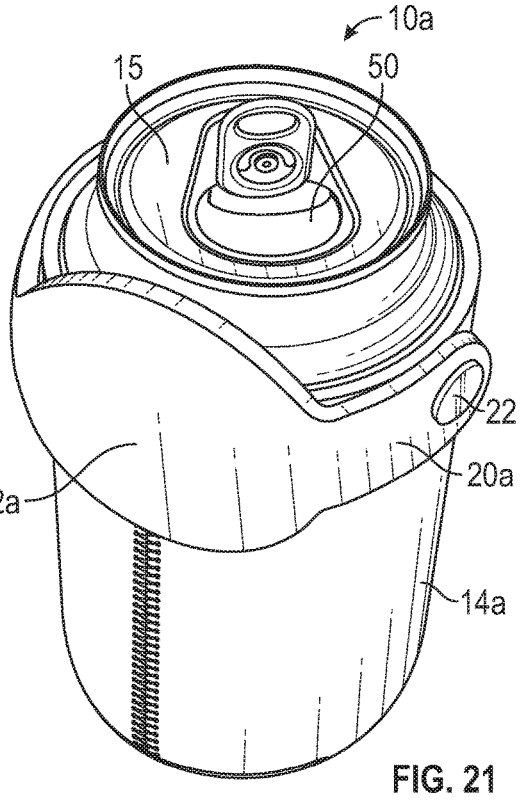
FIG. 21 is a perspective view of the container holder of FIGS. 19 and 20, turned 45 degrees from the position shown in FIGS. 19 and 20, with the cover attached on both sides of the container holder but pulled down away from the mouth of the can.
Figure 22:
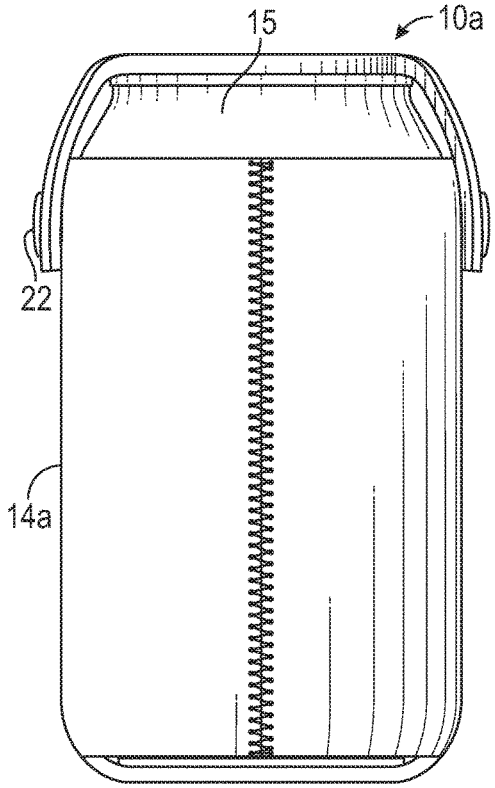
FIG. 22 is a front view of the container holder with cover of FIG. 19, showing the cover closed across the top of the can.
Figure 23:
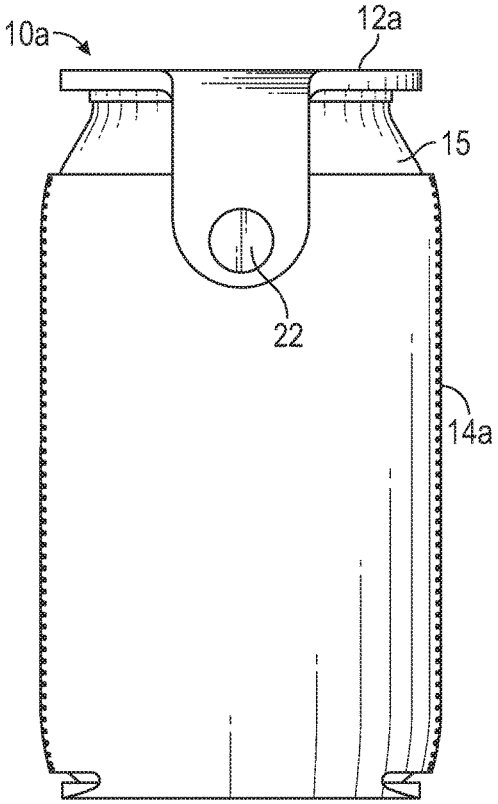
FIG. 23 is a side view of the container holder with cover of FIG. 19, showing the cover closed across the top of the can.
Figure 24:
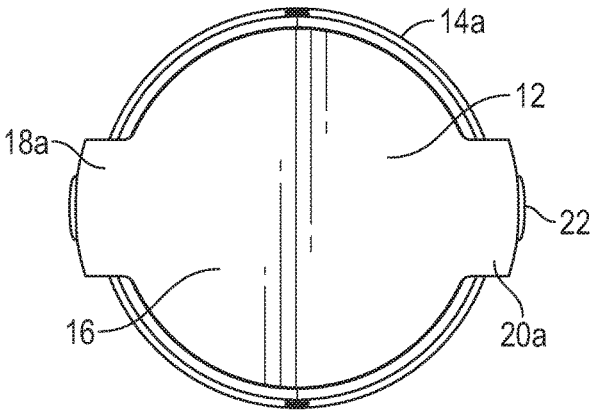
FIG. 24 is a top view of the container holder with cover of FIG. 19, showing the cover closed across the top of the can.
Figure 25:
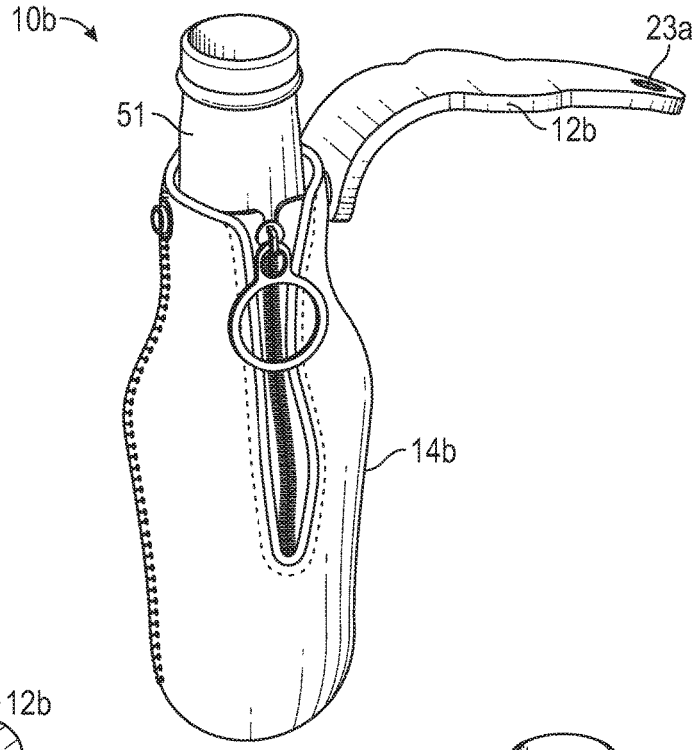
FIG. 25 is a perspective view of yet another embodiment of a beverage container holder or Koozie®-type container holder with cover of the present invention, particularly suited for a bottle, showing the cover flipped open away from the mouth of the bottle inside the Koozie®-type container.

The material used for the cover 12 will affect how closely the cover may fit to the beverage container being held in holder 10. For example, in the embodiment shown in FIGS. 19 through 24, sleeve 14*a* and cover 12*a* are comprised for example of neoprene with a polyester coating that affords the sleeve some insulating qualities while being soft, easy to grip, flexible, light in weight, and slightly stretchy. The polyester coating affords some slipperiness to the surface. This slippery quality and the like composition of the cover 12*a* and the sleeve 14*a* enable the cover 12*a* to easily slip back and forth in closed and open positions, as shown for example in FIG. 20 (closed) and FIG. 21 (open). The flexibility of the material allows the cover 12*a* to wrap over the container top and hug the container top, with the flaps 18*a* and 20*a* fitting snuggly about the top of the container or can 15 and down to the sleeve 14*a* attachment, snaps 22. This snug fit enables the cover 12*a* to effectively provide a closure or facsimile of closure to the mouth 50 of the can 15 sufficient to prevent or slow spillage of the beverage from the container in the event the holder 10 and container are tipped over. The flexibility of the material also allows cover 12*a* and particularly flaps 18*a* and 20*a*, when detached from the sleeve 14, to lay flat for easy storage and transport.

Figure 26:
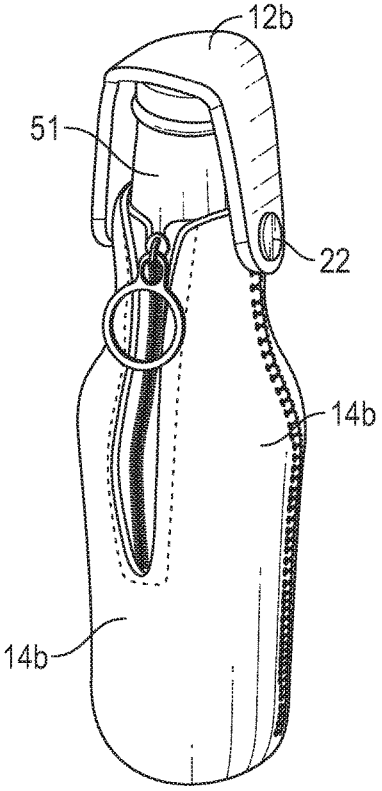
FIG. 26 is a perspective view of the container holder of FIG. 25 with the cover closed across the top of the bottle.
Figure 27:
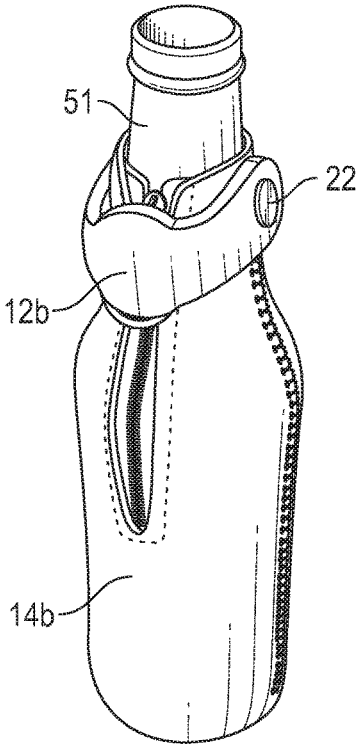
FIG. 27 is a perspective view of the container holder of FIGS. 25 and 26, with the cover attached on both sides of the container holder but pulled down away from the mouth of the bottle.
Figure 28:
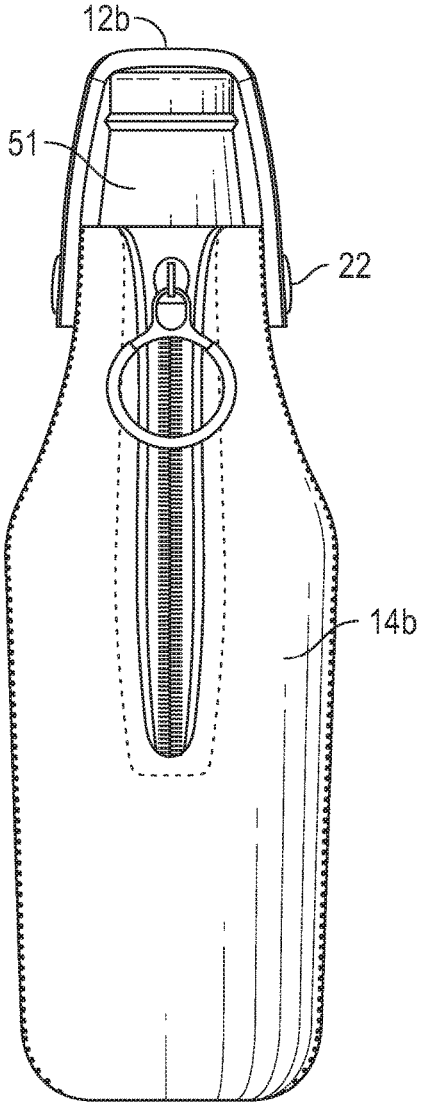
FIG. 28 is a front view of the container holder with cover of FIG. 25, showing the cover closed across the top of the bottle.
Figure 29:
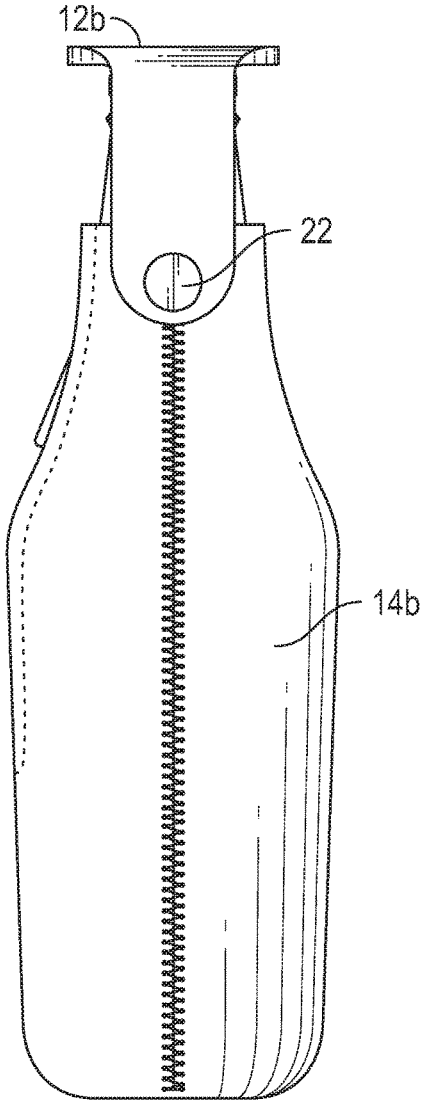
FIG. 29 is a side view of the container holder with cover of FIG. 25, showing the cover closed across the top of the bottle.
Figure 30:
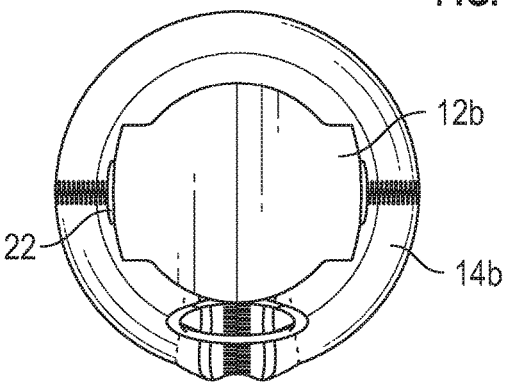
FIG. 30 is a top view of the container holder with cover of FIG. 25, showing the cover closed across the top of the bottle.
Figure 31:
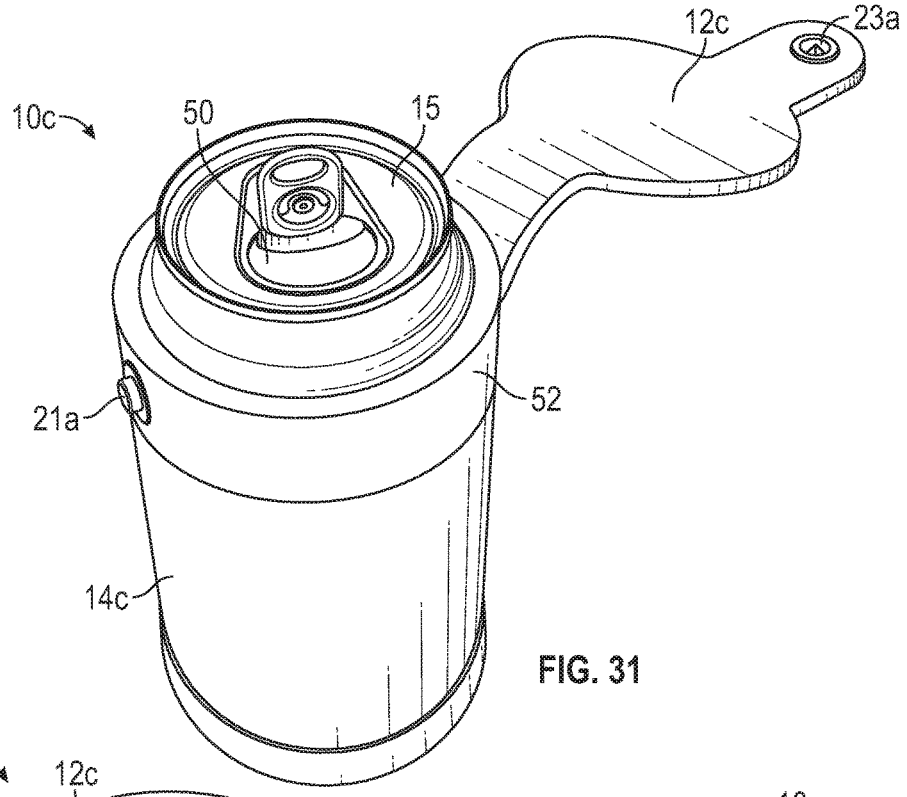
FIG. 31 is a perspective view of yet another embodiment of a beverage container holder or container holder with cover of the present invention, particularly suited for a can, showing the cover flipped open away from the mouth of the can inside the container holder.
Figure 32:
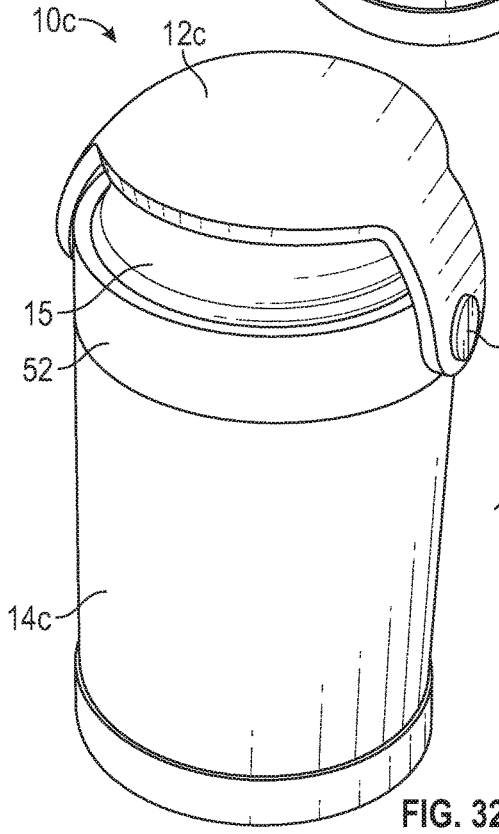
FIG. 32 is a perspective view of the container holder of FIG. 31 with the cover closed across the top of the can.
Figure 33:
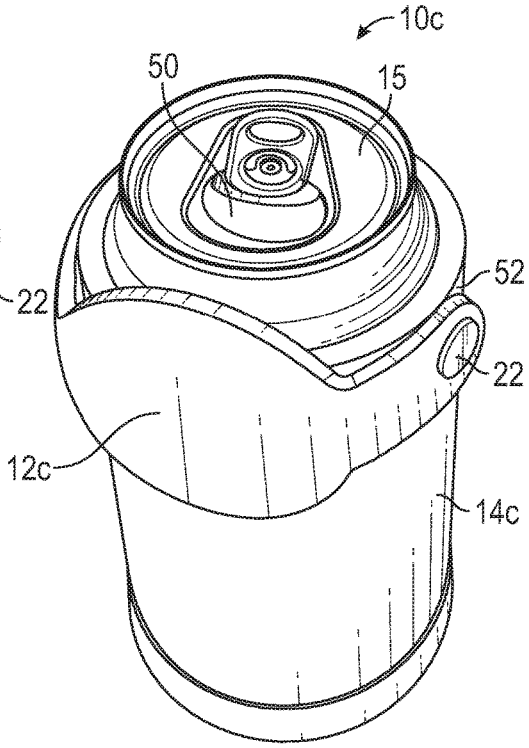
FIG. 33 is a perspective view of the container holder of FIGS. 31 and 32, with the cover attached on both sides of the container holder but pulled down away from the mouth of the can.
Figure 34:
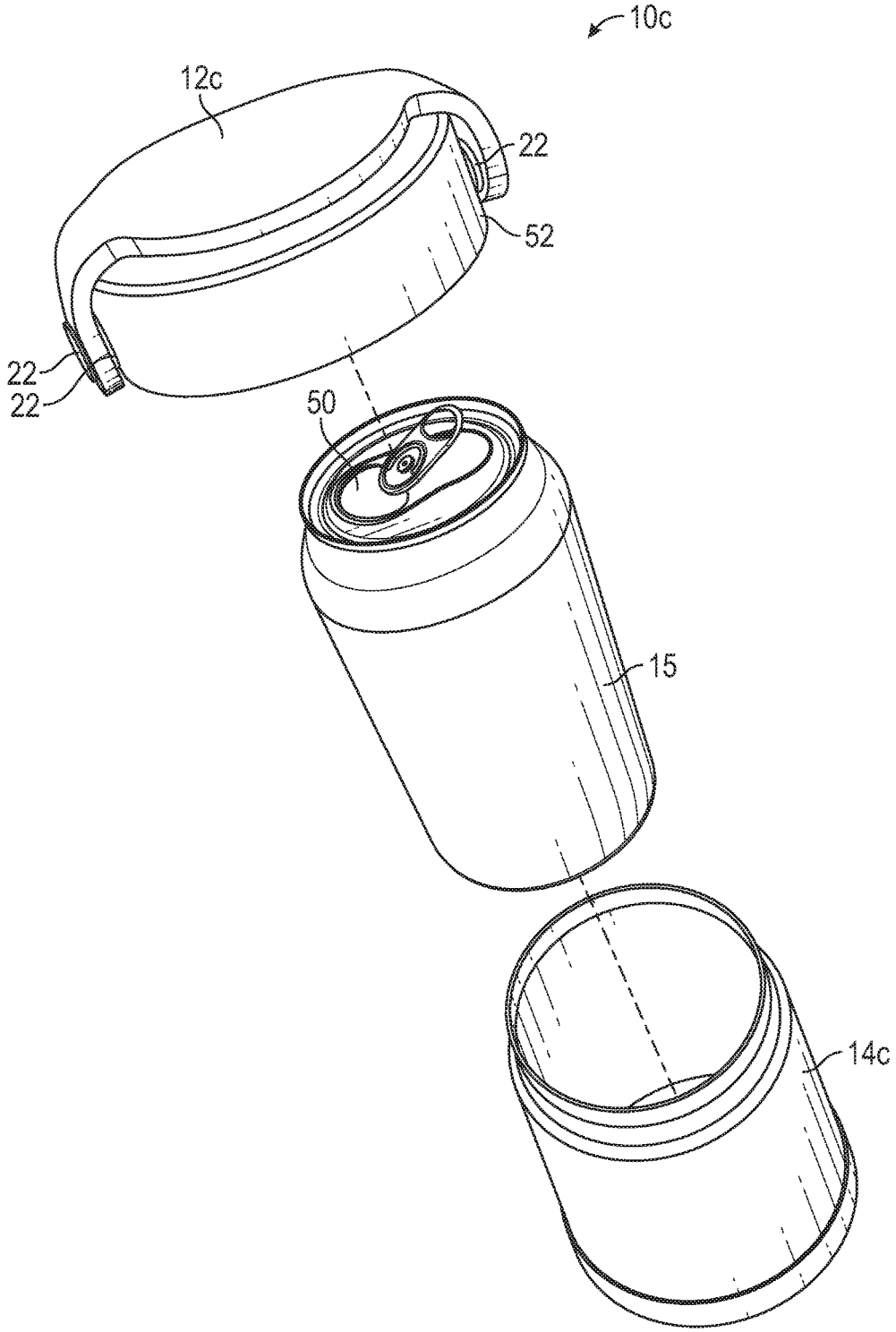
FIG. 34 is an exploded view of the container holder with cover of FIG. 32.
Figure 35:
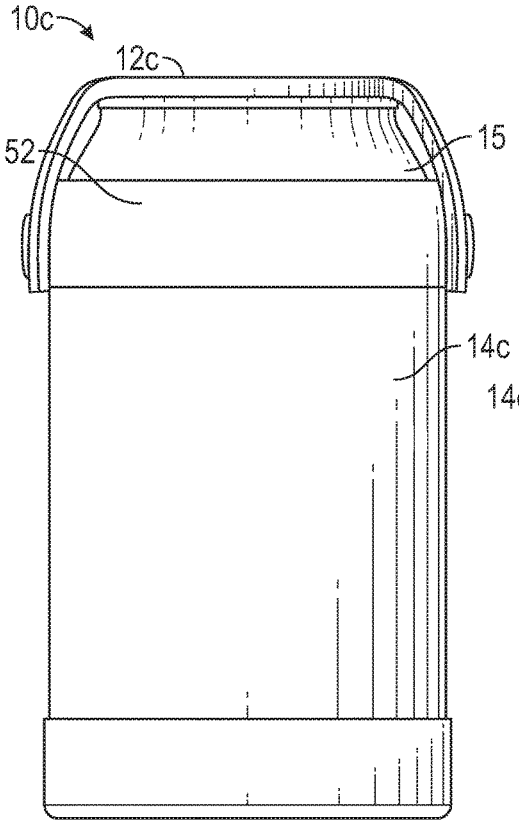
FIG. 35 is a front view of the container holder with cover of FIGS. 31 and 32, showing the cover closed across the top of the can.
Figure 36:
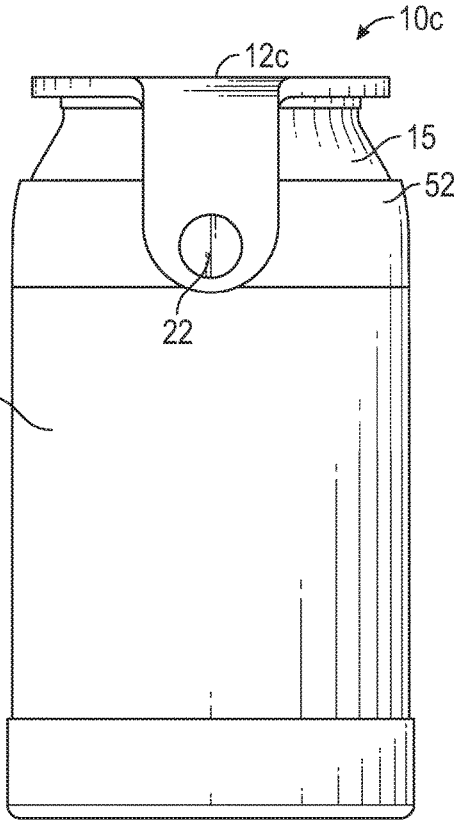
FIG. 36 is a side view of the container holder with cover of FIGS. 31, 32 and 35, showing the cover closed across the top of the can.
Figure 37:
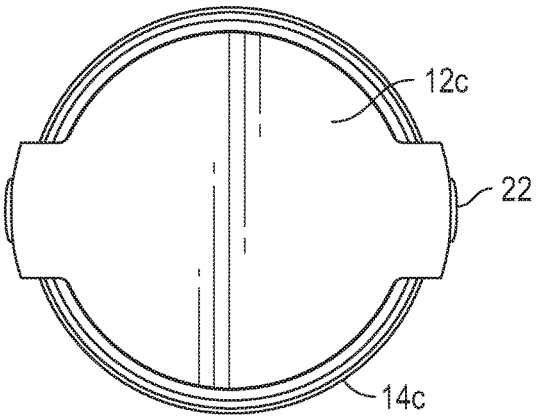
FIG. 37 is a top view of the container holder with cover of FIGS. 31, 32, 35 and 36, showing the cover closed across the top of the can.
Figure 38:
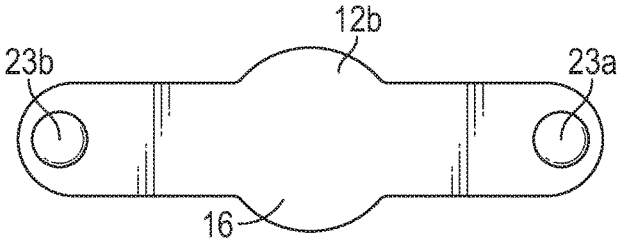
FIG. 38 is a top view of the cover of the beverage container holder or container holder of FIG. 25, particularly suited for a bottle.
Figure 39:
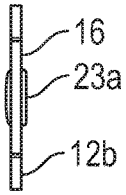
FIG. 39 is an end view of the cover of FIG. 38.
Figure 40:
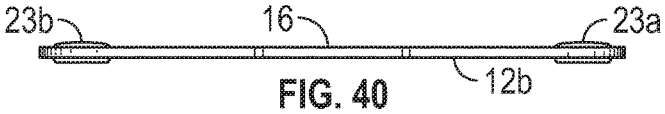
FIG. 40 is a is side view of the cover of FIG. 38.
Figure 41:
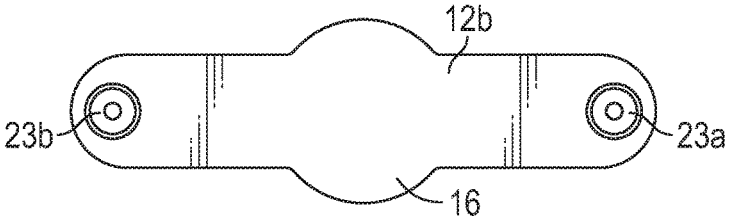
FIG. 41 is bottom view of the cover of FIG. 38.
Figure 42:
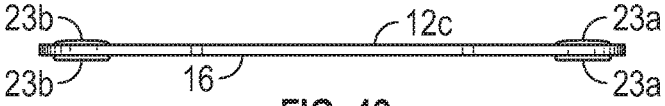
FIG. 42 is a side view of cover of the beverage container holder or container holder of FIGS. 19 and 31, particularly suited for a can.
Figure 43:
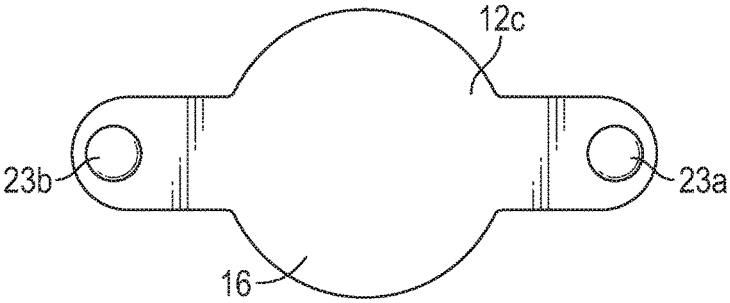
FIG. 43 is a top view of the cover of FIG. 42.
Figure 44:
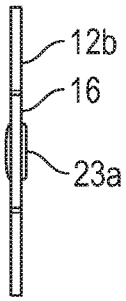
FIG. 44 is an end view of the cover of FIG. 42.
Figure 45:
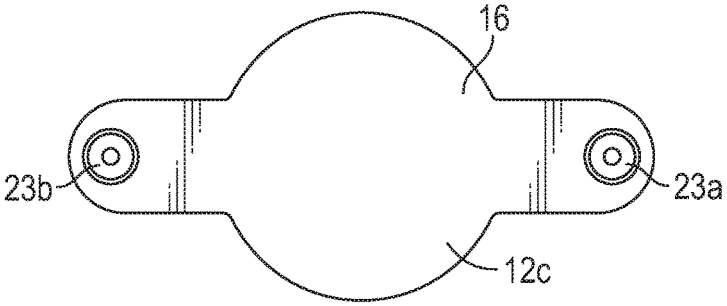
FIG. 45 is a bottom view of the cover of FIG. 42.

It will be understood by those skilled in the art that the holder 10 may be a different shape from those shown in the Figures without departing from the spirit of the present invention. It will also be understood by those skilled in the art that the shape and size of the holder and particularly the sleeve and cover may be changed to accommodate the change in size and/or shape of beverage container to be held in the holder. For non-limiting example, FIGS. 25 through 30 show an embodiment of holder 10 comprised of the same materials as used for the embodiment shown in FIGS. 19 through 24, but for a sleeve 14*b* adapted to hold a bottle 51 instead of a can 15. As shown with the flaps 18*a* and 20*a* in FIG. 22, the flaps 18*b* and 20*b* in this embodiment, because of their flexible material, wrap over the top of bottle 51 and hug the bottle, with the flaps 18*b* and 20*b* fitting snuggly about the top of the bottle 51 and down to the sleeve 14*b* attachment, snaps 22, as shown in FIG. 26. This snug fit enables the cover 12*b* to effectively provide a closure or facsimile of closure to the mouth of the bottle sufficient to prevent or slow spillage of the beverage from the bottle in the event the holder 10 and bottle are tipped over.

It will still further be understood by those skilled in the art that features of the invention illustrated in specific embodiments illustrated in Figures herein may be combined with other embodiments of the invention described herein without departing from the spirit of the present invention. For non-limiting example, FIGS. 31 through 37 illustrate an embodiment of the holder 10 of the invention where the cover 12*c* and the sleeve 14*c* are comprised of different materials. That is, sleeve 14*c* is comprised of a hard, insulating material, as is common with beverage coolers such as the Yeti Colster® cooler and similar stainless steel coolers by Rtic and Ozark. Cover 12*c* is comprised of a soft, flexible material comprising neoprene for example like covers 12*a* and 12*b* discussed above. As shown with the flaps 18*a* and 20*a* in FIG. 22, the flaps 18*c* and 20*c* in this embodiment, because of their flexible material, wrap over the top of can 15 and hug the top of the can, with the flaps 18*c* and 20*c* fitting snuggly about the top of the can 15. Different however from the sleeve 14 shown in FIGS. 1 through 11, sleeve 14*c* in FIGS. 31 through 37 comprises a cap 52 to which the flaps 18*c* and 20*c* attach with fasteners, snaps 22 for example, and the cap 52 fits onto the main body of sleeve 14*c*, rather than the flaps 18*c* and 20*c* of cover 12*c* attaching directly to the main body of sleeve 14*c*. Nevertheless, cover 12*c* provides a snug fit which enables the cover 12*c* to effectively provide a closure or facsimile of closure to the mouth of the can in the holder 10 sufficient to prevent or slow spillage of beverage from the can 15 in the event the holder 10 and can are tipped over.

An advantage of the present invention is that it can be readily adapted to existing Koozie®-type container holders and individual beverage coolers. That is, cover 12, preferably comprised of a flexible material, and connectors or fasteners such as snaps 22, and optionally or alternatively cap 52, may be comprised in a kit for adapting common soft Koozie®-type container holders without a cover, and known hard Koozie®-type container holders and coolers such as the Yeti Colster® cooler and similar stainless steel coolers by Rtic and Ozark, to have the advantages of the invention. The kit could optionally include a tool for facilitating installation of the snaps 22 or other fasteners on an existing Koozie®-type container holder or cooler or other personalized beverage container holder sleeve. In one embodiment, the cover already includes the female snaps as shown in the drawings herein, and the kit user would only need to install the male snap on a soft sided Koozie®-type container holder or substitute the cap provided with the male snaps for one on the hard sided cooler.

While preferred embodiments of the present disclosure have been described, it should be understood that other various changes, adaptations and modifications can be made therein without departing from the spirit of the invention and the scope of the appended claims.

Appendix

| List of Numbers Used | |
|---|---|
| 10 | Beverage Container Holder With Cover (Apparatus of Invention) |
| 12 | Cover |
| 12a | Cover of One Alternative Embodiment |
| 12b | Cover of Another Embodiment |
| 12c | Cover of Still Another Embodiment |
| 14 | Sleeve |
| 14a | Sleeve of One Alternative Embodiment |
| 14b | Sleeve of Another Embodiment |
| 14c | Sleeve of Still Another Embodiment |
| 15 | Can |
| 16 | Disk |
| 18 | First Flap of Cover |
| 20 | Second Flap of Cover |

-continued

| Appendix | |
|---|---|
| List of Numbers Used | |
| 21a | First Male Snap |
| 21b | Second Male Snap |
| 22 | Pair of Snap Fasteners (including Male and Female Snaps) |
| 23a | First Female Snap |
| 23b | Second Female Snap |
| 25 | Upper Disk Surface |
| 27 | Lower Disk Surface |
| 28 | Edge of Disk |
| 29 | First Upper Flap Surface |
| 30 | First Lower Flap Surface |
| 31 | First Rounded Flap Edge |
| 33 | Second Upper Flap Surface |
| 34 | Second Lower Flap Surface |
| 35 | Second Rounded Flap Edge |
| 41 | Sleeve Inner Surface |
| 42 | Sleeve Outer Surface |
| 50 | Mouth of Can |
| 51 | Bottle |
| 52 | Sleeve Cap |

The invention claimed is:

1. A portable beverage container holder for a beverage container having an opening or mouth at its top, the holder comprising:

a sleeve mimicking or capable of mimicking the shape of at least the lower half of the beverage container, for receiving and holding the beverage container;

a cover for covering the mouth of the beverage container;

wherein the cover is removably connected or attached to the sleeve with a pair of snap fasteners and the cover is slidable or rotatable on said snap fasteners so that the cover is pullable down over at least a portion of the top of the sleeve so as to uncover the mouth of the beverage container without detaching the cover from the sleeve.

2. The holder of claim 1 wherein the sleeve and the cover are comprised of the same material.

3. The holder of claim 1 wherein the sleeve and the cover are comprised of a neoprene fabric or material.

4. The holder of claim 1 wherein the cover is comprised of neoprene and polyester.

5. The holder of claim 1 wherein the sleeve is comprised of plastic or metal and the cover is comprised of neoprene or a fabric comprising neoprene.

6. The holder of claim 5 wherein the plastic is rigid or flexible.

7. The holder of claim 1 wherein the sleeve is an insulating sleeve.

8. The holder of claim 1 wherein the snap fasteners are comprised of plastic.

9. The holder of claim 1 wherein the sleeve is rigid and has a cap for receiving the cover.

10. The holder of claim 1 wherein the cover in place over the mouth of the container prevents entry of insects or spiders into the container.

* * * * *